US010156411B2

(12) United States Patent
Thompson et al.

(10) Patent No.: US 10,156,411 B2
(45) Date of Patent: Dec. 18, 2018

(54) SYSTEMS AND METHODS FOR COUPLING SUPPRESSORS OR OTHER MUZZLE END BARREL DEVICES TO FIREARMS

(71) Applicant: Daniel Defense, Inc., Black Creek, GA (US)

(72) Inventors: Dewayne Lee Thompson, Lexington, KY (US); Larry Joe Ross Jones, Monroe, GA (US); Marvin C. Daniel, Pooler, GA (US)

(73) Assignee: Daniel Defense, Inc., Black Creek, GA (US)

( * ) Notice: Subject to any disclaimer, the term of this patent is extended or adjusted under 35 U.S.C. 154(b) by 0 days.

(21) Appl. No.: 15/911,253

(22) Filed: Mar. 5, 2018

(65) Prior Publication Data

US 2018/0292164 A1 Oct. 11, 2018

Related U.S. Application Data

(60) Provisional application No. 62/482,443, filed on Apr. 6, 2017.

(51) Int. Cl.
*F41A 21/32* (2006.01)
*F41A 21/36* (2006.01)
*F41A 21/34* (2006.01)

(52) U.S. Cl.
CPC ..... *F41A 21/325* (2013.01); *F41A 21/36* (2013.01); *F41A 21/34* (2013.01)

(58) Field of Classification Search
CPC ..... F41A 21/325; F41A 21/32; F41A 21/34; F41A 21/30; F41A 21/40; F41A 21/36
USPC ..... 89/14.1–14.5; 42/90; 181/223
See application file for complete search history.

(56) References Cited

U.S. PATENT DOCUMENTS 5,685,102 A * 11/1997 Latka ..... F41A 21/325 42/76.01
5,773,746 A * 6/1998 Vaden ..... F41A 21/325 181/223
7,594,464 B2 * 9/2009 Dueck ..... F41A 21/30 89/14.2
7,735,406 B1 * 6/2010 Olson ..... F41A 21/325 89/14.3
7,789,009 B1 * 9/2010 Brittingham ..... F41A 21/325 181/223
8,291,805 B1 * 10/2012 Quilligan ..... F41A 21/325 285/305
8,490,535 B1 * 7/2013 Moore ..... F41A 21/30 89/14.2
8,714,300 B2 * 5/2014 Johansen ..... F41A 21/325 181/223
8,910,746 B1 * 12/2014 McKenzie ..... F41A 21/30 181/223
9,631,888 B2 * 4/2017 Young ..... F41A 21/325
(Continued)

*Primary Examiner* — Reginald S Tillman, Jr.
(74) *Attorney, Agent, or Firm* — Eversheds Sutherland (US) LLP

(57) ABSTRACT

An assembly for coupling a device to a firearm is disclosed. The device may be a suppressor, flash hider, compensator, or the like. The assembly may include a muzzle brake, a coupling body attached to the muzzle brake, a moveable collar disposed around the coupling body, at least one moveable clamp sandwiched between the coupling body and the moveable collar, a device core attached to the coupling body, and a spring disposed between the device core and the moveable collar.

20 Claims, 12 Drawing Sheets

(56) References Cited

U.S. PATENT DOCUMENTS

| | | | | |
|---|---|---|---|---|
| 2003/0019351 | A1* | 1/2003 | Fluhr | F41A 21/30 89/14.4 |
| 2007/0095198 | A1* | 5/2007 | Dater | F41A 21/325 89/14.2 |
| 2012/0180623 | A1* | 7/2012 | Graham, II | F41A 21/325 89/14.4 |
| 2017/0167816 | A1* | 6/2017 | Young | F41A 21/325 |

* cited by examiner

SYSTEMS AND METHODS FOR COUPLING SUPPRESSORS OR OTHER MUZZLE END BARREL DEVICES TO FIREARMS

CROSS-REFERENCE TO RELATED APPLICATIONS

The disclosure claims priority to and the benefit of U.S. provisional patent application No. 62/482,443, filed Apr. 6, 2017, which is incorporated by reference herein in its entirety.

FIELD OF THE DISCLOSURE

The disclosure generally relates to suppressors or other muzzle end barrel devices and more particularly relates to systems and methods for coupling suppressors or other muzzle end barrel devices to firearms.

BACKGROUND

Suppressors, flash hiders, compensators, and other muzzle end barrel devices are configured to compensate for the various effects of firing a projectile (such as a bullet) from a firearm. Some of the effects include, but are not limited to, muzzle jump, muzzle recoil, muzzle blast, muzzle flash, and/or vibrations. For example, muzzle, jump and muzzle recoil can adversely impact accuracy by altering the position of the firearm after each shot. Muzzle blast is the loud noise that generally accompanies the discharge of a firearm. Muzzle blast can damage the ears of the operator or nearby individuals not wearing ear protection and can bring unwanted attention in instances of covert use. Muzzle flash is the bright flash that generally accompanies the discharge of a firearm. Muzzle flash can adversely affect vision and draw unwanted attention to the use of the firearm. Excessive vibrations can impact the mechanical integrity of the firearm.

Thus, the incorporation of a suppressor, flash hider, compensator, or other muzzle end barrel device to a firearm may provide a number of benefits. Typical muzzle end barrel device coupling assemblies, however, may be cumbersome and unreliable.

Therefore, there is a need for systems and methods for coupling muzzle end barrel devices to firearms.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
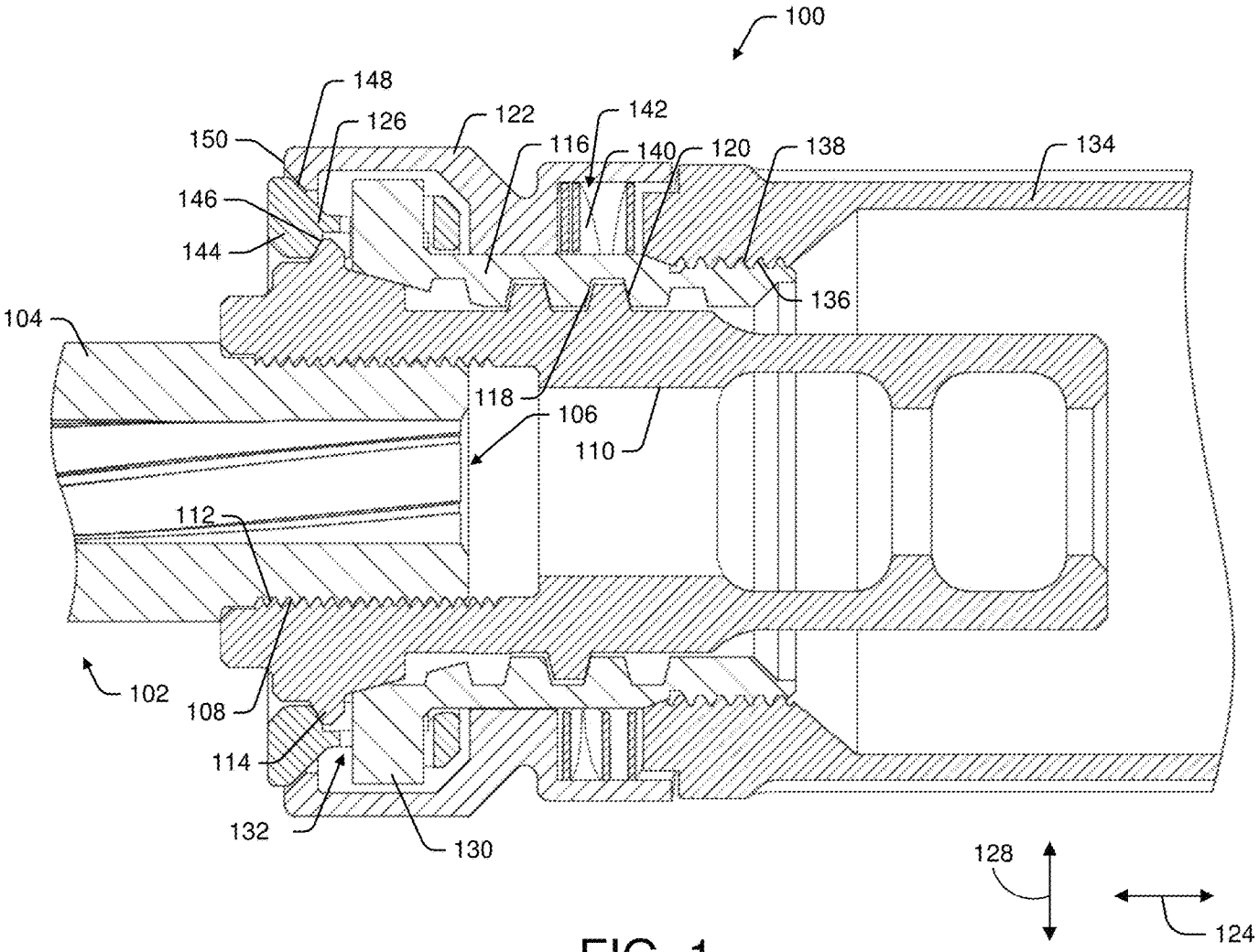
FIG. 1 depicts a cross-sectional view of a suppressor coupling assembly in accordance with one or more embodiments of the disclosure.

Described below are embodiments of a muzzle end barrel device coupling assembly. In certain embodiments, the muzzle end barrel device coupling assembling comprises a suppressor coupling assembly (as well as individual components of the suppressor coupling assembly) for attaching a suppressor to a firearm. Methods of installing and using the suppressor coupling assembly on the firearm are also disclosed. In some instances, the suppressor coupling assembly may be a quick attachment/detachment assembly. For example, in certain embodiments, the suppressor coupling assembly may not require tools to attach the suppressor to the firearm. That is, a user may attach the suppressor to the firearm by hand without the use of tools. In other embodiments, the muzzle end barrel device coupling assembly may be used to attach a flash hider, compensator, or the like to the firearm. The muzzle end barrel device coupling assembly may be used to attach any device to the end of the barrel of the firearm.

The firearm may be a conventional firearm. For example, the firearm may be an M-16 style rifle, an AR-15 style rifle, an AR-10 style rifle, or an M-4 style rifle, among others. In some instances, the firearm may be a shotgun or a handgun. Any firearm may be used. The suppressor coupling assembly may be configured to attach the suppressor to a muzzle end of the firearm. The suppressor may reduce the muzzle jump, muzzle recoil, muzzle blast, and/or muzzle flash generated by the firing of the firearm by slowing, expanding, trapping, and/or cooling the propellant gases associated with the firing of the firearm.

Generally speaking, the suppressor coupling assembly may include a muzzle brake attachable to the muzzle end of the firearm. In some instances, the muzzle brake may include a flange. A coupling body may be attachable to the muzzle brake, and a moveable collar may be disposed around the coupling body. The moveable collar may include an unlocked position and a locked position. The suppressor coupling assembly also may include at least one moveable clamp sandwiched between the coupling body and the moveable collar. The at least one moveable clamp may include an unclamped position that corresponds to the unlocked position of the moveable collar and a clamped position (e.g., about the flange of the muzzle brake) that corresponds to the locked position of the moveable collar. A suppressor core may be attachable to the coupling body, and a spring may be disposed between the suppressor core and the moveable collar. In some instances, the spring may bias the movable collar towards the locked position. The suppressor core may include one or more baffles, chambers, ports, etc. therein for reducing the muzzle jump, muzzle recoil, muzzle blast, and/or muzzle flash generated by the firing of the firearm by slowing, expanding, trapping, and/or cooling the propellant gases associated with the firing of the firearm. In some instances, the suppressor core may include a monocore baffle. In other instances, the suppressor core may comprise stacked baffles. Any type of suppressor core may be used herein. In addition, the suppressor core may be any suitable size, shape, or configuration.

These and other embodiments of the disclosure will be described in more detail through reference to the accompanying drawings in the detailed description of the disclosure that follows. This brief introduction, including section titles and corresponding summaries, is provided for the reader's convenience and is not intended to limit the scope of the claims or the proceeding sections. Furthermore, the techniques described above and below may be implemented in a number of ways and in a number of contexts. Several example implementations and contexts are provided with reference to the following figures, as described below in more detail. However, the following implementations and contexts are but a few of many.

FIGS. 1-10D depict a suppressor coupling assembly 100 for attaching a suppressor to a firearm 102. The firearm 102 may include a barrel 104 and a muzzle end 106. In some instances, the muzzle end 106 may include external threads 108.

The suppressor coupling assembly 100 may include a muzzle brake 110. The muzzle brake 110 may be attachable to the muzzle end 106 of the barrel 104. Any muzzle attachment may be used herein. For example, the muzzle brake 110 may include internal threads 112 that correspond to the external threads 108 on the muzzle end 106 of the barrel 104. In this manner, the muzzle brake 110 may be threaded onto the muzzle end 106 of the barrel 104. The muzzle brake 110 may include one or more ports or baffles. The muzzle brake 110 may be any suitable size, shape, or configuration. The muzzle brake 110 may include a flange 114. In some instances, the flange 114 may be circular and extend about an outer circumference of the muzzle brake 110. The flange 114 may be any suitable size, shape, or configuration.

In certain embodiments, a coupling body 116 may be attachable to the muzzle brake 110. For example, the coupling body 116 may include internal threads 118 that correspond to the external threads 120 on the muzzle brake 110. In this manner, the coupling body 116 may be threaded onto the muzzle brake 110. The coupling body 116 may be any suitable size, shape, or configuration.

Figure 2:
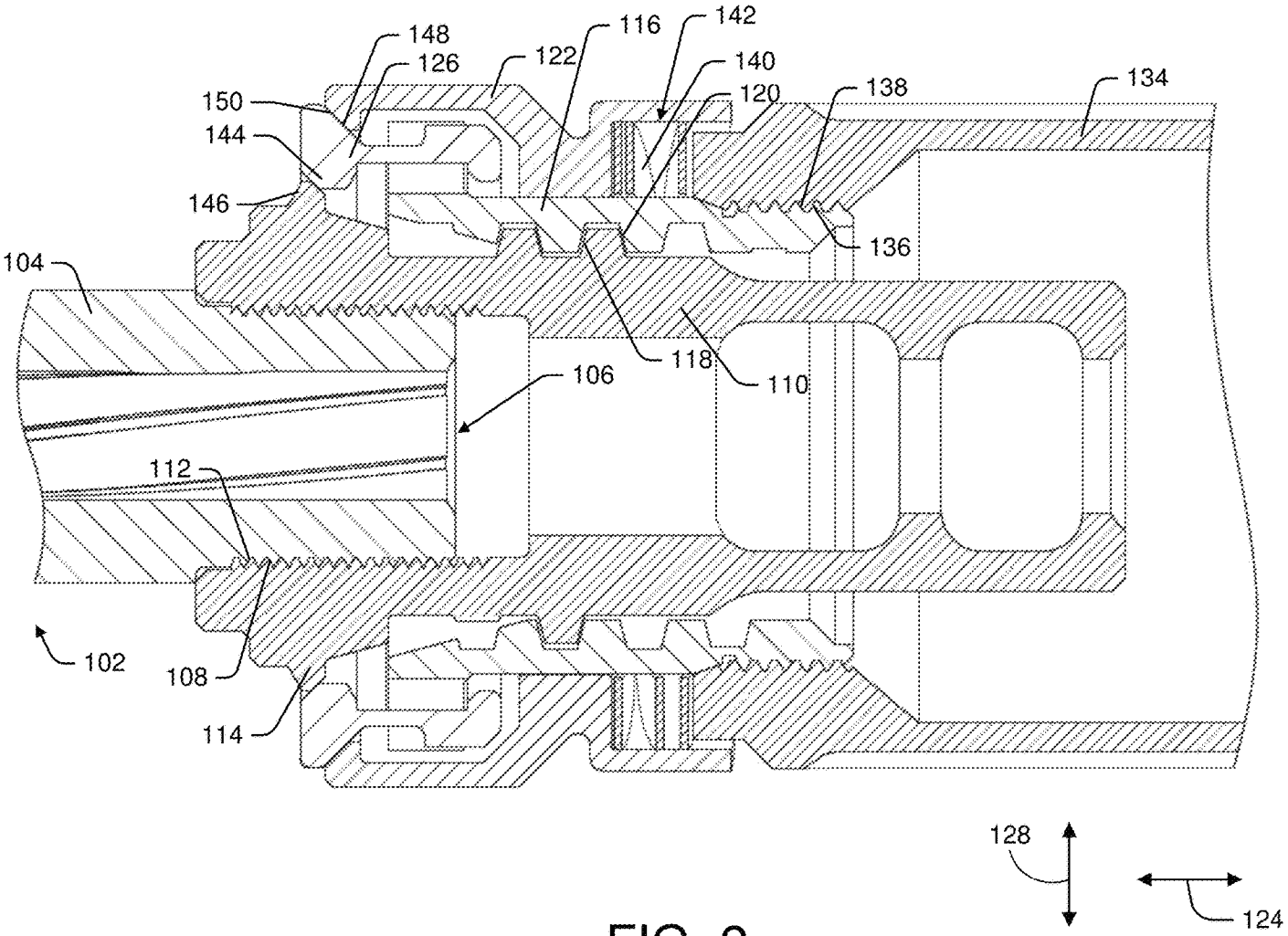
FIG. 2 depicts a cross-sectional view of a suppressor coupling assembly in accordance with one or more embodiments of the disclosure.

The suppressor coupling assembly 100 also may include a moveable collar 122. The moveable collar 122 may be disposed around the coupling body 116. The moveable collar 122 may include an unlocked position (as depicted in FIG. 2) and a locked position (as depicted in FIG. 1). For example, the moveable collar 122 may be moveable in an axial direction (as indicated by arrow 124) between the unlocked position and the locked position. The moveable collar 122 may be any suitable size, shape, or configuration.

Figure 5:
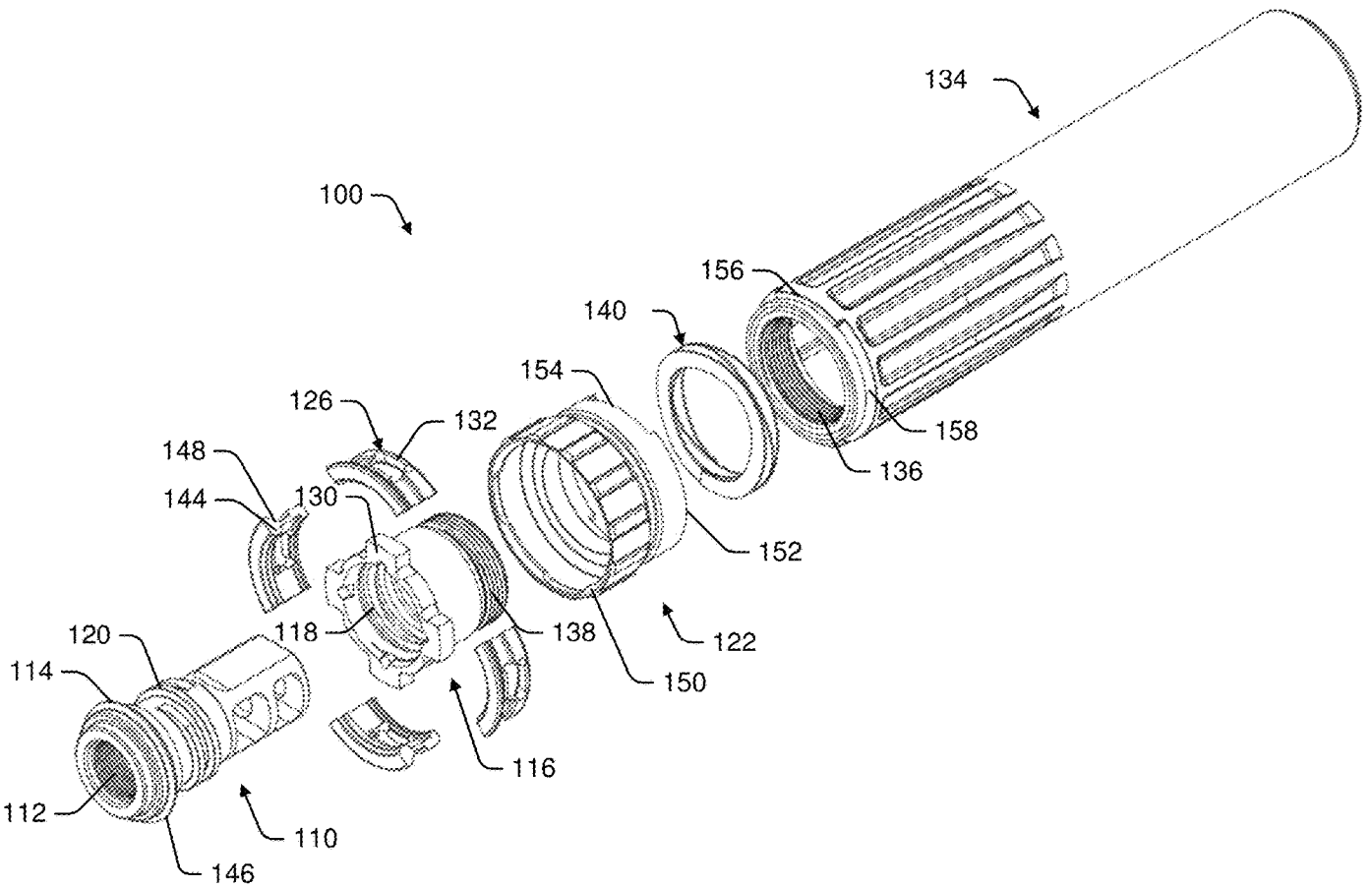
FIG. 5 depicts an exploded view of a suppressor coupling assembly in accordance with one or more embodiments of the disclosure.
Figure 6:
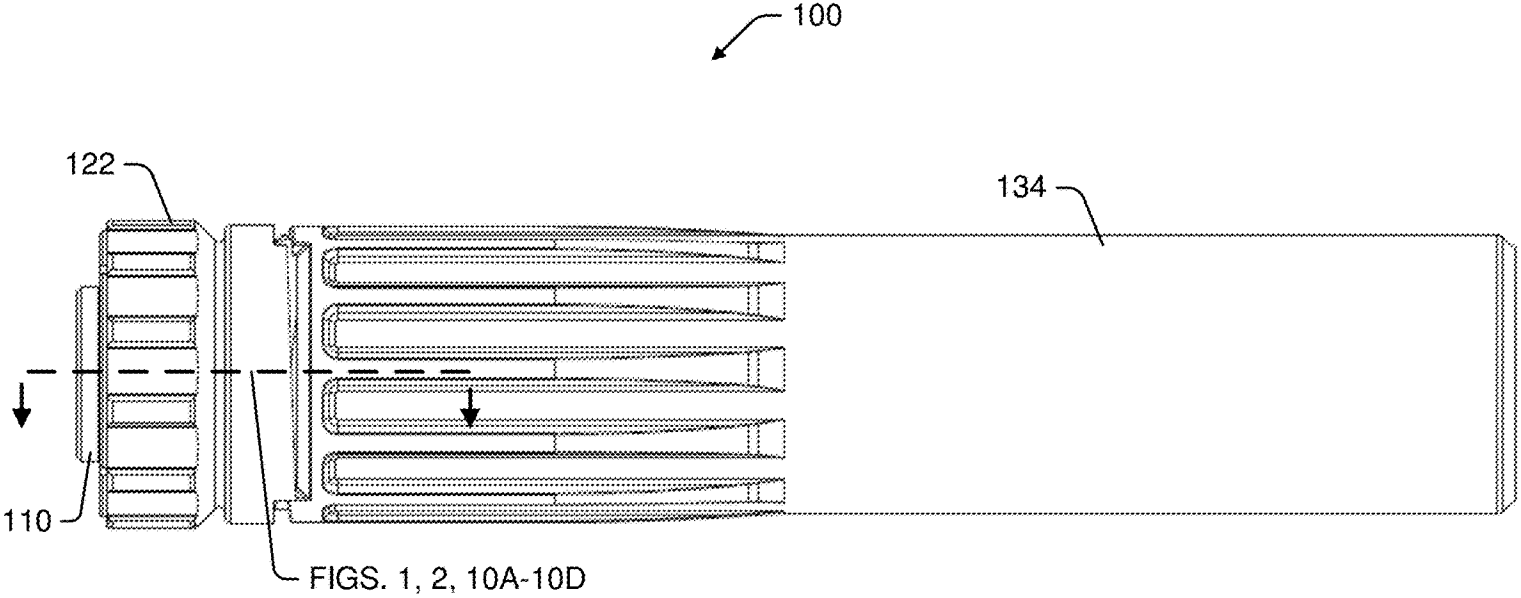
FIG. 6 depicts a side view of a suppressor coupling assembly in accordance with one or more embodiments of the disclosure.
Figure 7:
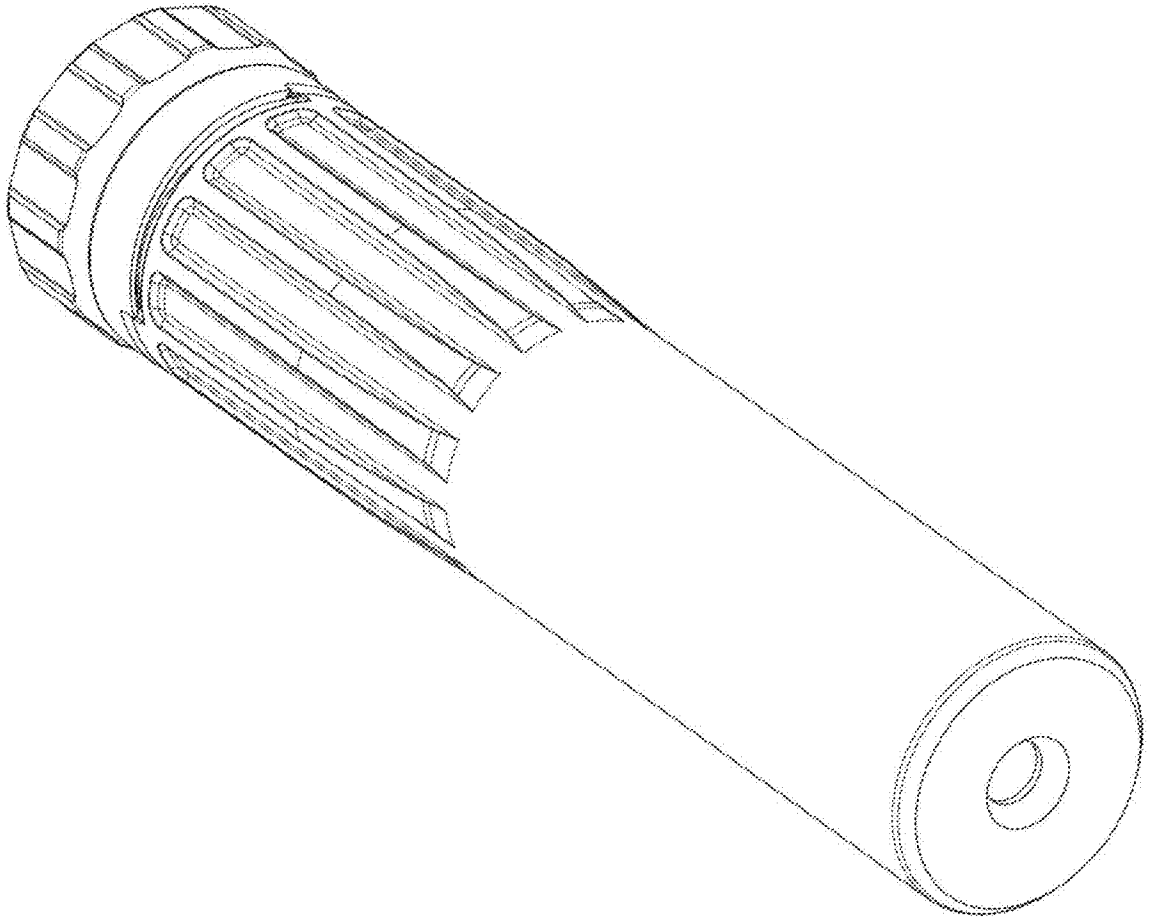
FIG. 7 depicts an upper view of a suppressor coupling assembly in accordance with one or more embodiments of the disclosure.
Figure 9:
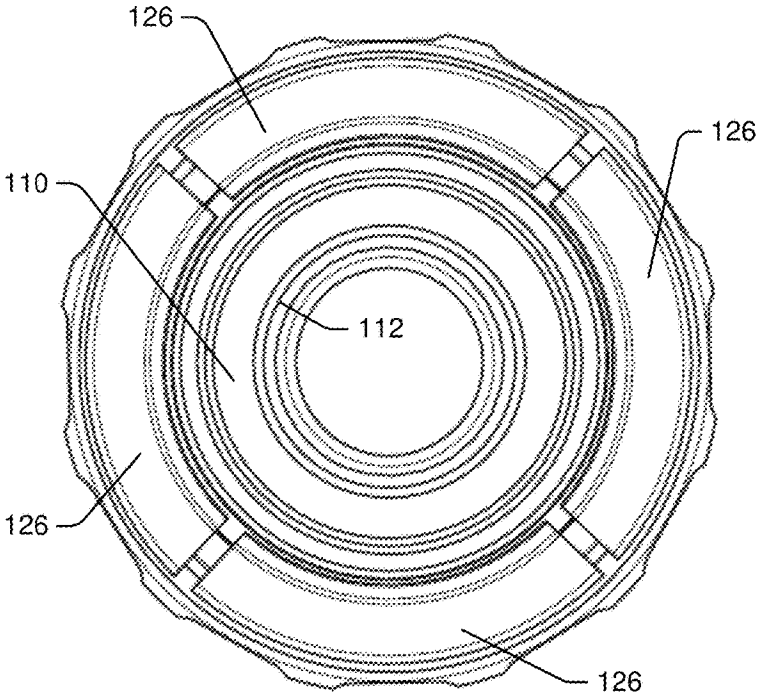
FIG. 9 depicts a rear view of a suppressor coupling assembly in accordance with one or more embodiments of the disclosure.
Figure 8:
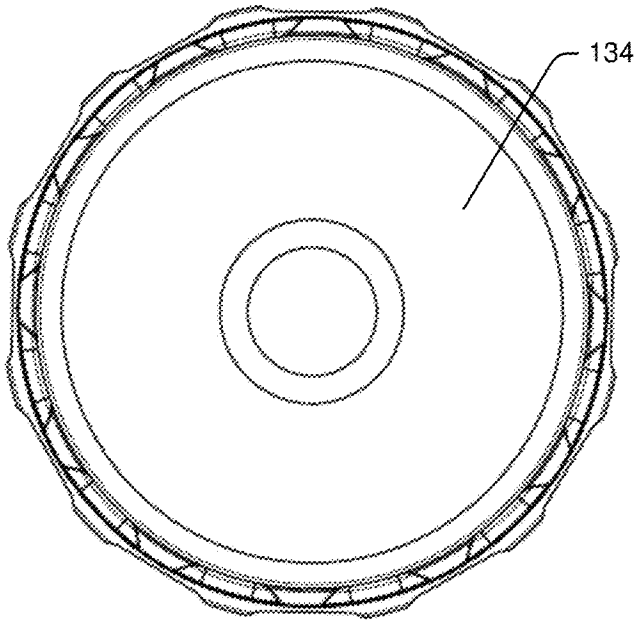
FIG. 8 depicts a front view of a suppressor coupling assembly in accordance with one or more embodiments of the disclosure.
Figure 10A:
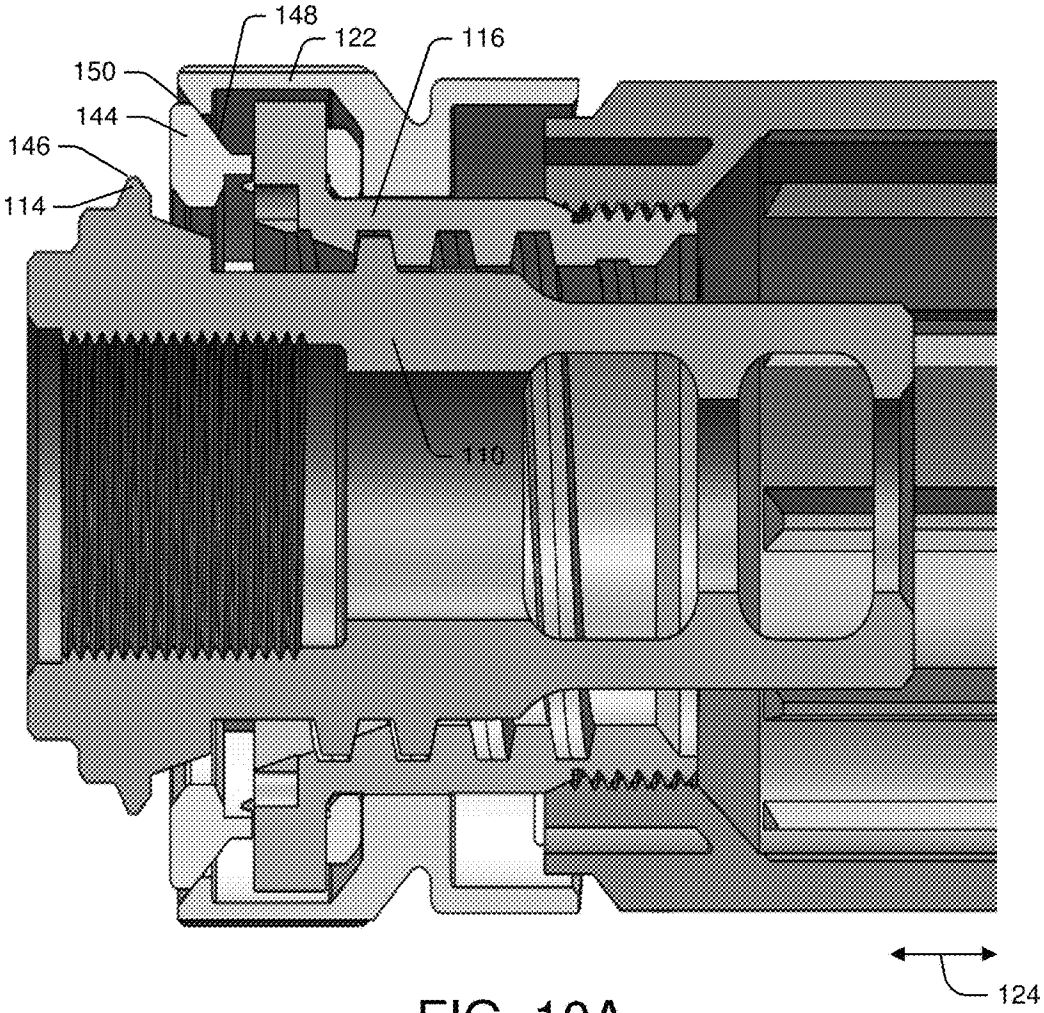
FIGS. 10A-10D depict a sequence of a suppressor coupling assembly moving from an unclamped position to a clamped position in accordance with one or more embodiments of the disclosure.
Figure 10B:
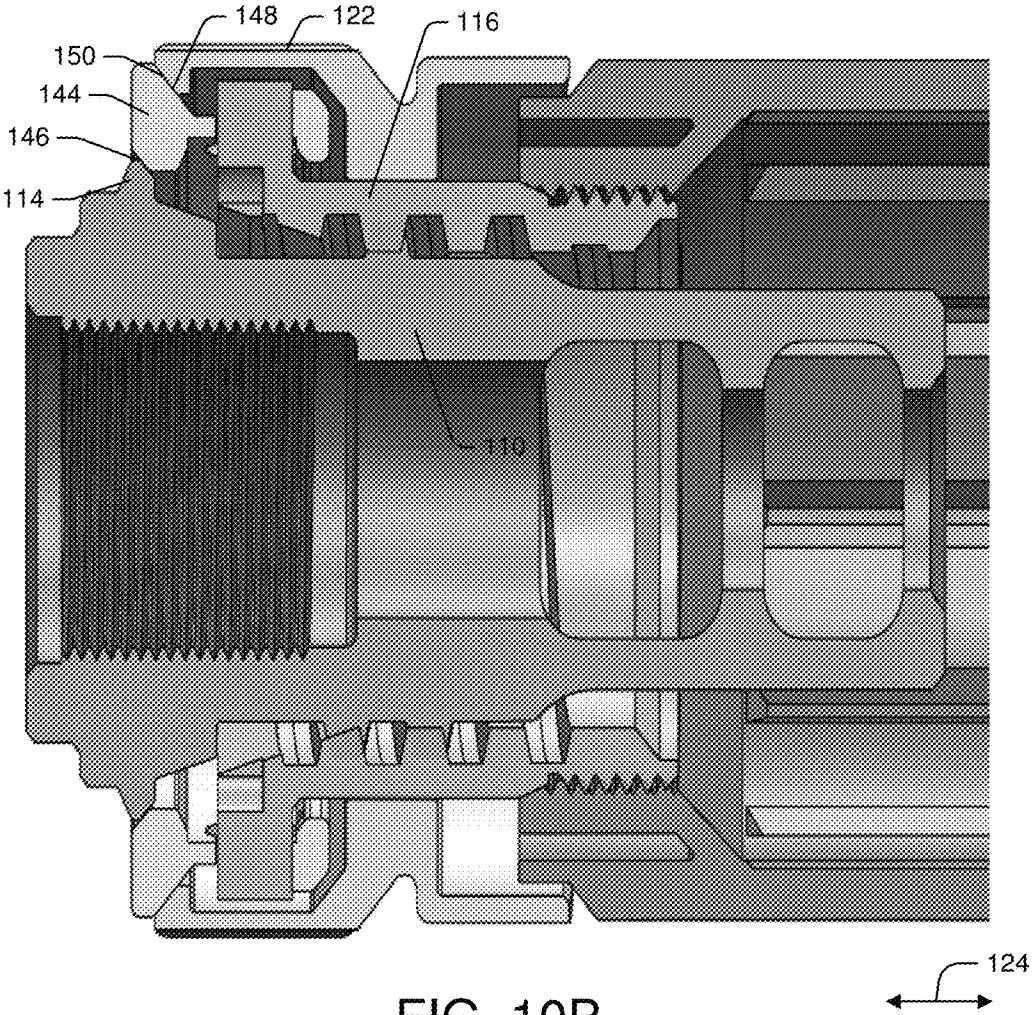
Figure 10C:
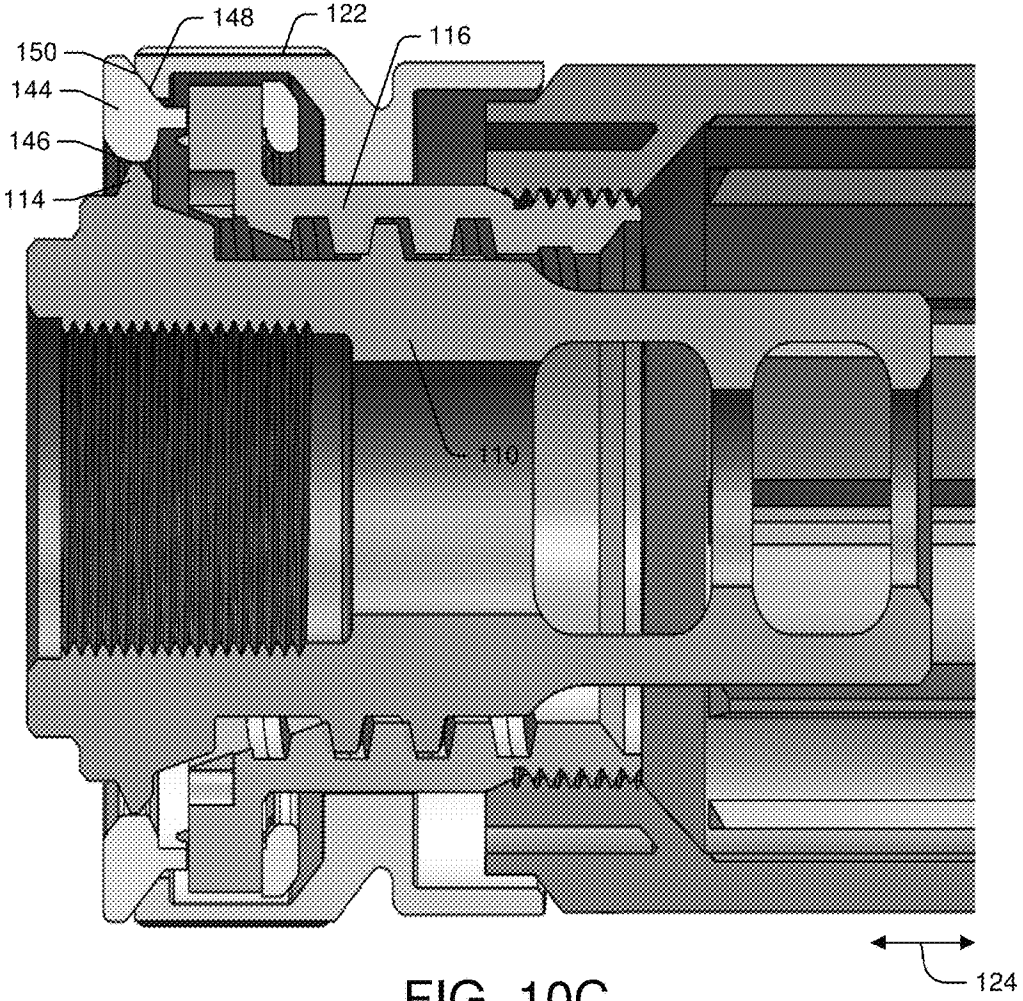
Figure 10D:
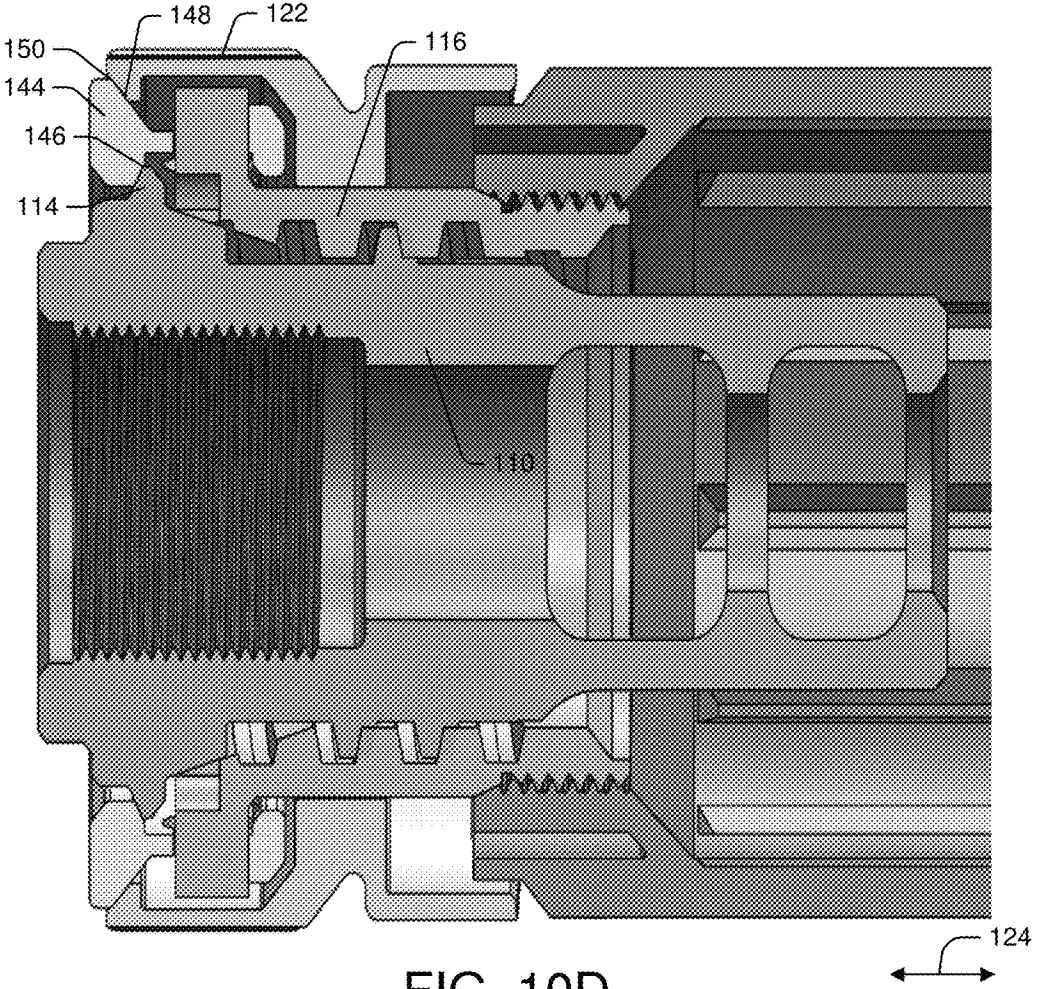

In certain embodiments, at least one moveable clamp 126 may be sandwiched between the coupling body 116 and the moveable collar 122. In some instances, as depicted in FIG. 5, the at least one moveable clamp 126 may comprise four (4) moveable clamps equally spaced around the coupling body 116.

The at least one moveable clamp 126 may include an unclamped position (as depicted in FIG. 2) that corresponds to the unlocked position of the moveable collar 122 and a clamped position (as depicted in FIG. 1) that corresponds to the locked position of the moveable collar 122. For example, the at least one moveable clamp 126 may be moveable in a radial direction (as indicated by arrow 128) between the unclamped position and the clamped position. In an example embodiment, the coupling body 116 may include at least one protuberance 130 configured to mate with at least one hole 132 in the at least one moveable clamp 126. In this manner, the at least one moveable clamp 126 may move in the radial direction 128 along the at least one protuberance 130 via the at least one hole 132. As discussed in greater detail below, when in the clamped position, the at least one moveable clamp 126 may form a clamp about the flange 114 of the muzzle brake 110 to prevent the suppressor from disengaging from the firearm 102. The at least one moveable clamp 126 may be any suitable size, shape, or configuration.

The suppressor coupling assembly 100 also may include a suppressor core 134. The suppressor core 134 may be attachable to the coupling body 116. Any device body may be attached to the coupling body 116. For example, the suppressor core 134 may include internal threads 136 that correspond to the external threads 138 on the coupling body 116. In this manner, the suppressor core 134 may be threaded onto the coupling body 116. The suppressor core 134 may include one or more baffles, chambers, ports, etc. therein for reducing the muzzle jump, muzzle recoil, muzzle blast, and/or muzzle flash generated by the firing of the firearm by slowing, expanding, trapping, and/or cooling the propellant gases associated with the firing of the firearm. The suppressor core 134 may be any suitable size, shape, or configuration.

In certain embodiments, a spring 140 may be disposed between the suppressor core 134 and the moveable collar 122. For example, the spring 140 may be disposed within a void 142 formed between the moveable collar 122, the coupling body 116, and the suppressor core 134. The spring 140 may bias the movable collar 122 towards the locked position. In some instances, the spring 140 may be a multi-wave spring or the like. The spring 140 may be any suitable size, shape, or configuration.

Turning now to the operation of the suppressor coupling assembly 100, the at least one moveable clamp 126 may include a lip 144. The lip 144 may be configured to clamp about the flange 114 in the clamped position. For example, the flange 114 may comprise a flange ramp 146 extending from one side thereof to the other. In this manner, the flange ramp 146 may include a number of inclined planes, chamfered edges, rounded edges, or comprise a rounded knob. Likewise, the lip 144 may include a number of inclined planes, chamfered edges, rounded edges, or comprise a rounded knob. As a result, the lip 144 may be configured to engage and traverse the flange ramp. For example, the lip 144 may move in the axial direction 124 and/or radial direction 128 to move along the flange ramp 146 from one side of the flange 114 to the other. That is, the lip 144 may move along the flange ramp 146 from the left side of the flange 114 (which is the clamp position) to the right side of the flange 114 (which is the unclamped position) and vice versa.

In certain embodiments, movement of the lip 144 about the flange 114 may be actuated by the moveable collar 122.

For example, the at least one moveable clamp 126 may include a lip ramp 148 about the lip 144. The lip ramp 148 may include a number of inclined planes, chamfered edges, rounded edges, or comprise a rounded knob. In this manner, the moveable collar 122 may be configured to engage the lip ramp 148. For example, a rearward edge 150 (which may include an inclined plane or the like) of the moveable collar 122 may abut and push against the lip ramp 148. As a result, the flange ramp 146 and the lip ramp 148 may collectively move the at least one moveable clamp 126 between the unclamped position and the clamped position as the coupling body 116 is threaded onto the muzzle brake 110 and/or when the moveable collar 122 is moved between the unlocked position and the locked position, and vice versa. That is, the axial movement of the moveable collar 122 may be translated into both axial and radial movement via the flange ramp 146 and the lip ramp 148 as the coupling body 116 is threaded onto the muzzle brake 110.

For example, when moving the at least one clamp 126 from the unclamped position to the clamped position, as depicted in sequence shown in FIGS. 10A-10D, the coupling body 116 may be threaded onto the muzzle brake 110, which may cause the moveable collar 122 to move in the axial direction 124, which may cause the rearward edge 150 of the moveable collar 122 to abut and push against the ramp lip 148, resulting in the lip 144 being pinched between the flange ramp 146 and the lip ramp 148. Consequently, the lip 144 may move leftward and radially outward over an apex of the flange 114, at which point the lip 144 may move leftward and radially inward to clamp against the flange 114. As discussed in greater detail below, the moveable collar 122 may be locked into position to prevent the lip 144 from inadvertently backing off of the flange 114 to the unclamped position.

Conversely, to move the at least one clamp 126 from the clamped position to the unclamped position, the moveable collar 122 may be unlocked, and the coupling body 116 may be unthreaded from the muzzle brake 110, which may cause the moveable collar 122 to move in the axial direction 124. Consequently, as the coupling body 116 is unthreaded from the muzzle brake 110, the lip 144 may move rightward and radially outward over an apex of the flange 114, at which point the lip 144 may continue moving rightward passed the flange 114 to the unclamped position.

As noted above, the moveable collar 122 may include a locked position and an unlocked position. The locked position may maintain the at least one clamp 126 in the clamped position. In contrast, the unlocked position may enable the at least one clamp 126 to move between the clamped and unclamped position.

Figure 3:
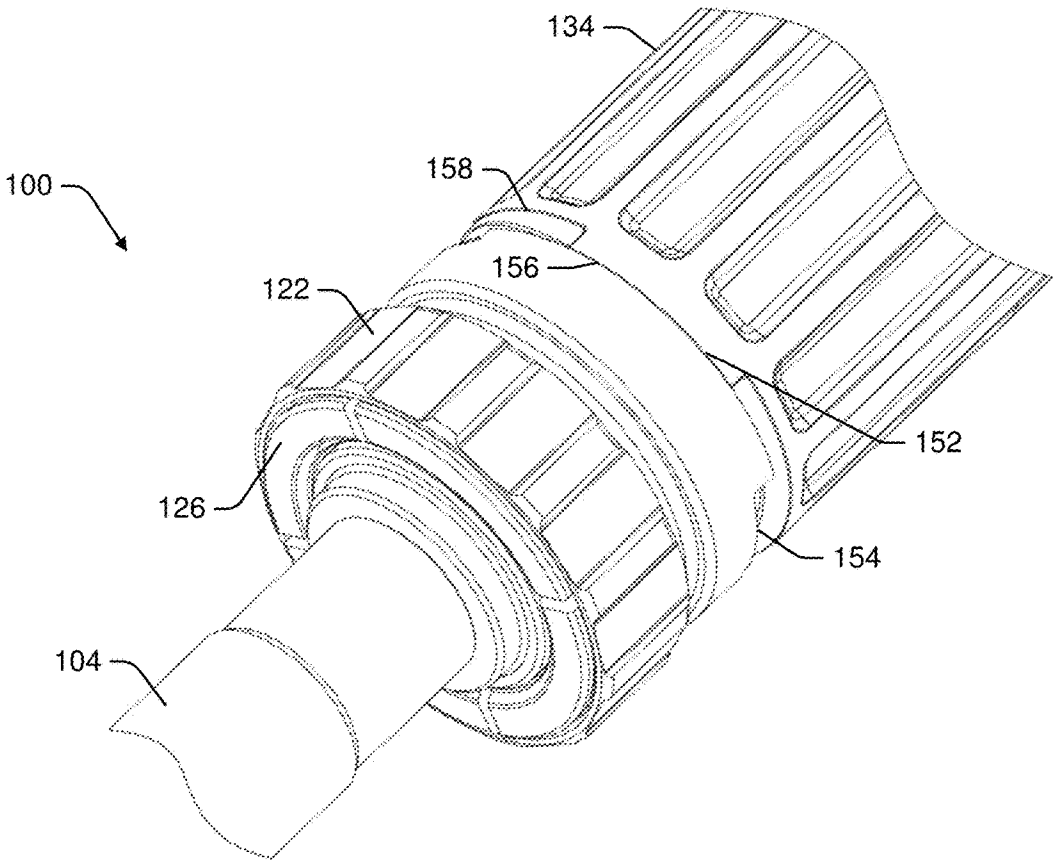
FIG. 3 depicts an upper view of a suppressor coupling assembly in accordance with one or more embodiments of the disclosure.
Figure 4:
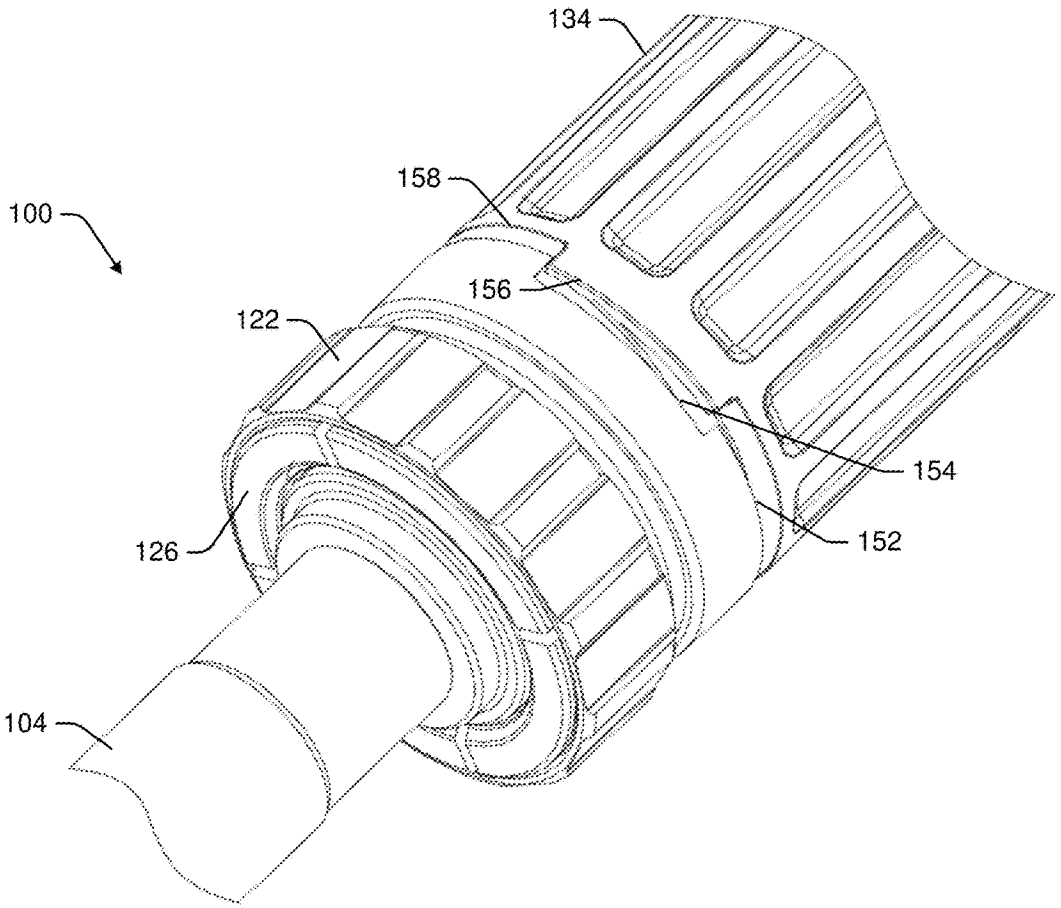
FIG. 4 depicts an upper view of a suppressor coupling assembly in accordance with one or more embodiments of the disclosure.

For example, as depicted in FIGS. 3-5, the moveable collar 122 may include a forward edge 152. The forward edge 152 of the movable collar 122 may include at least one notch 154. Similarly, the suppressor core 134 may include a rearward edge 156. The rearward edge 156 of the suppressor core 134 may include at least one slot 158. In this manner, when the moveable collar 122 is in the unlocked position, the forward edge 152 of the moveable collar 122 may be positionable within the at least one slot 158 in the rearward edge 156 of the suppressor core 134, and the rearward edge 156 of the suppressor core 134 may be positionable within the at least one notch 154 in the forward edge 152 of the moveable collar 122. Conversely, when the moveable collar 122 is in the locked position, the forward edge 152 of the moveable collar 122 may be positionable against the rearward edge 156 of the suppressor core 134, which may force the rearward edge 150 of the moveable collar 122 to abut and push against the lip ramp 148, resulting in the lip 144 clamping down about the flange 114. In some instances, the forward edge 152 of the moveable collar 122 and the rearward edge 156 of the suppressor core 134 may collectively move the moveable collar 122 between the locked position and the unlocked position by rotating the moveable collar 122 so at to move the movable collar 122 in the axial direction 124.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. An assembly for coupling a device to a firearm, the assembly comprising:
- a muzzle attachment;
- a coupling body attached to the muzzle attachment;
- a moveable collar disposed around the coupling body;
- at least one moveable clamp sandwiched between the coupling body and the moveable collar;
- a device body attached to the coupling body; and
- a spring disposed between the device body and the moveable collar.

2. An assembly for coupling a suppressor to a firearm, the firearm having a muzzle end, the assembly comprising:
- a muzzle brake attachable to the muzzle end, wherein the muzzle brake comprises a flange;
- a coupling body attachable to the muzzle brake;
- a moveable collar disposed around the coupling body, wherein the moveable collar comprises an unlocked position and a locked position;
- at least one moveable clamp sandwiched between the coupling body and the moveable collar, wherein the at least one moveable clamp comprises an unclamped position that corresponds to the unlocked position of the moveable collar and a clamped position about the flange that corresponds to the locked position of the moveable collar;
- a suppressor core attachable to the coupling body; and
- a spring disposed between the suppressor core and the moveable collar.

3. The assembly of claim 2, wherein the flange is disposed about the circumference of the muzzle brake.

4. The assembly of claim 2, wherein the coupling body comprises at least one protuberance configured to mate with at least one hole in the at least one moveable clamp.

5. The assembly of claim 2, wherein the at least one moveable clamp is moveable in a radial direction between the unclamped position and the clamped position.

6. The assembly of claim 2, wherein the moveable collar is moveable in an axial direction between the unlocked position and the locked position.

7. The assembly of claim 2, wherein the at least one moveable clamp comprises a lip configured to clamp about the flange in the clamped position.

8. The assembly of claim 7, wherein the flange comprises a flange ramp.

9. The assembly of claim 8, wherein the lip is configured to engage and traverse the flange ramp.

10. The assembly of claim 9, wherein the lip comprises a lip ramp.

11. The assembly of claim 10, wherein the moveable collar is configured to engage the lip ramp, wherein the flange ramp and the lip ramp collectively move the at least one moveable clamp between the unclamped position and the clamped position as the moveable collar is moved between the unlocked position and the locked position.

12. The assembly of claim 2, wherein a forward edge of the moveable collar comprises at least one notch, and wherein a rearward edge of the suppressor core comprises at least one slot.

13. The assembly of claim 12, wherein the forward edge is positionable within the at least one slot and the rearward edge is position within the at least one notch when the moveable collar is in the unlocked position.

14. The assembly of claim 12, wherein the forward edge is positionable against the rearward edge when the moveable collar is in the locked position.

15. The assembly of claim 2, wherein the muzzle brake comprises internal threads attachable to corresponding external threads of the muzzle end, and wherein the muzzle brake comprises external threads attachable to corresponding internal threads of the coupling body.

16. The assembly of claim 2, wherein the coupling body comprises external threads attachable to corresponding internal threads of the suppressor core.

17. The assembly of claim 2, wherein the spring biases the movable collar towards the locked position.

18. An assembly for coupling a suppressor to a firearm, the assembly comprising:

a muzzle brake comprising a flange;

a coupling body attachable to the muzzle brake;

a moveable collar disposed around the coupling body, wherein the moveable collar comprises an unlocked position and a locked position, wherein the moveable collar is moveable in an axial direction between the unlocked position and the locked position;

at least one moveable clamp sandwiched between the coupling body and the moveable collar, wherein the at least one moveable clamp comprises an unclamped position that corresponds to the unlocked position of the moveable collar and a clamped position about the flange that corresponds to the locked position of the moveable collar, wherein the at least one moveable clamp is moveable in a radial direction between the unclamped position and the clamped position;

a suppressor core attachable to the coupling body; and a spring disposed between the suppressor core and the moveable collar, wherein the spring biases the movable collar towards the locked position.

19. The assembly of claim 18, wherein the coupling body comprises at least one protuberance configured to mate with at least one hole in the at least one moveable clamp.

20. The assembly of claim 18, wherein the at least one moveable clamp comprises a lip configured to clamp about the flange in the clamped position, wherein the flange comprises a flange ramp, wherein the lip is configured to engage and traverse the flange ramp, wherein the lip comprises a lip ramp, wherein the moveable collar is configured to engage the lip ramp, wherein the flange ramp and the lip ramp collectively move the at least one moveable clamp between the unclamped position and the clamped position as the moveable collar is moved between the unlocked position and the locked position.

* * * * *